United States Patent [19]

Sakaino et al.

[11] Patent Number: 4,495,904

[45] Date of Patent: Jan. 29, 1985

[54] APPARATUS FOR FACILITATING ENGINE STARTING

[75] Inventors: Michio Sakaino, Saitama; Hisashi Igarashi, Tokyo; Yutaka Taniguchi, Saitama, all of Japan

[73] Assignee: Honda Giken Kogyo Kabushiki Kaisha, Tokyo, Japan

[21] Appl. No.: 429,623

[22] Filed: Sep. 30, 1982

[30] Foreign Application Priority Data

Jan. 14, 1982 [JP] Japan ..... 57-3333

[51] Int. Cl.[3] ..... F02N 17/00

[52] U.S. Cl. ..... 123/179 G; 123/520; 261/DIG. 67

[58] Field of Search ..... 123/179 G, 519, 520; 261/DIG. 67

[56] References Cited

U.S. PATENT DOCUMENTS

| | | | |
|---|---|---|---|
| 2,230,184 | 1/1941 | Horton | 123/179 G |
| 3,343,819 | 9/1967 | Sarto | 261/DIG. 67 |
| 3,548,797 | 12/1970 | Hagihara et al. | 261/DIG. 67 |
| 3,614,945 | 10/1971 | Schlagmuller et al. | 123/179 G |
| 4,258,685 | 3/1981 | Arai et al. | 261/DIG. 67 |
| 4,343,281 | 8/1982 | Uozumi et al. | 123/520 |
| 4,377,146 | 3/1983 | Oniki et al. | 123/520 |

FOREIGN PATENT DOCUMENTS

| | | | |
|---|---|---|---|
| 17843 | 2/1978 | Japan | 261/DIG. 67 |

*Primary Examiner*—Parshotam S. Lall

*Attorney, Agent, or Firm*—Lyon & Lyon

[57] ABSTRACT

A solenoid operated cut valve controls flow through a vent passage leading from a float chamber for a carburetor for an internal combustion engine. A normally closed switch opens in response to high temperature of the engine, and a normally closed timer switch opens at the start of cranking and closes again after a predetermined time of cranking. The switches are connected to the solenoid to prevent increase in pressure within the float chamber from delivering an excessive amount of fuel to the air intake passage of the engine. In a modification, a switch responsive to vacuum intensity in the intake passage is included in the solenoid circuit to facilitate acceleration of the engine after a hot start.

7 Claims, 2 Drawing Figures

APPARATUS FOR FACILITATING ENGINE STARTING

The present invention relates to an apparatus for facilitating the starting of a vehicle engine.

Heretofore, there has been a conventional apparatus in which the float chamber of a carburetor interposed in an intake air passage of the engine communicates with a canister through an outer vent, the outer vent being provided with a cut valve for opening and closing it, said cut valve being closed at the time of cold starting of the engine. However, in such known apparatus, when the engine is to be restarted under a high temperature condition, the fuel in the float chamber is of relatively high temperature. In this condition, if relatively low temperature fuel is drawn into the chamber through a fuel line from an external source, there occurs a boiling phenomenon wherein low temperature fuel raises its temperature abruptly to evaporate when it is mixed with high temperature fuel, thereby increasing the internal pressure in the chamber. Thus, there is a deficiency since an objectionably large amount of fuel may be delivered from the float chamber into the intake air passage through the fuel nozzle.

An object of the present invention is to provide an apparatus having no such deficiency, wherein the float chamber of a carburetor interposed into an intake air passage of an engine communicates with a canister through an outer vent which is provided with a cut valve for opening and closing it; said cut valve is closed at the time of starting of the cold engine, and said cut valve is adapted to be opened and then closed with delay during the re-starting of the engine under a high temperature condition.

Other and more detailed objects and advantages will appear hereinafter.

Figure 1:
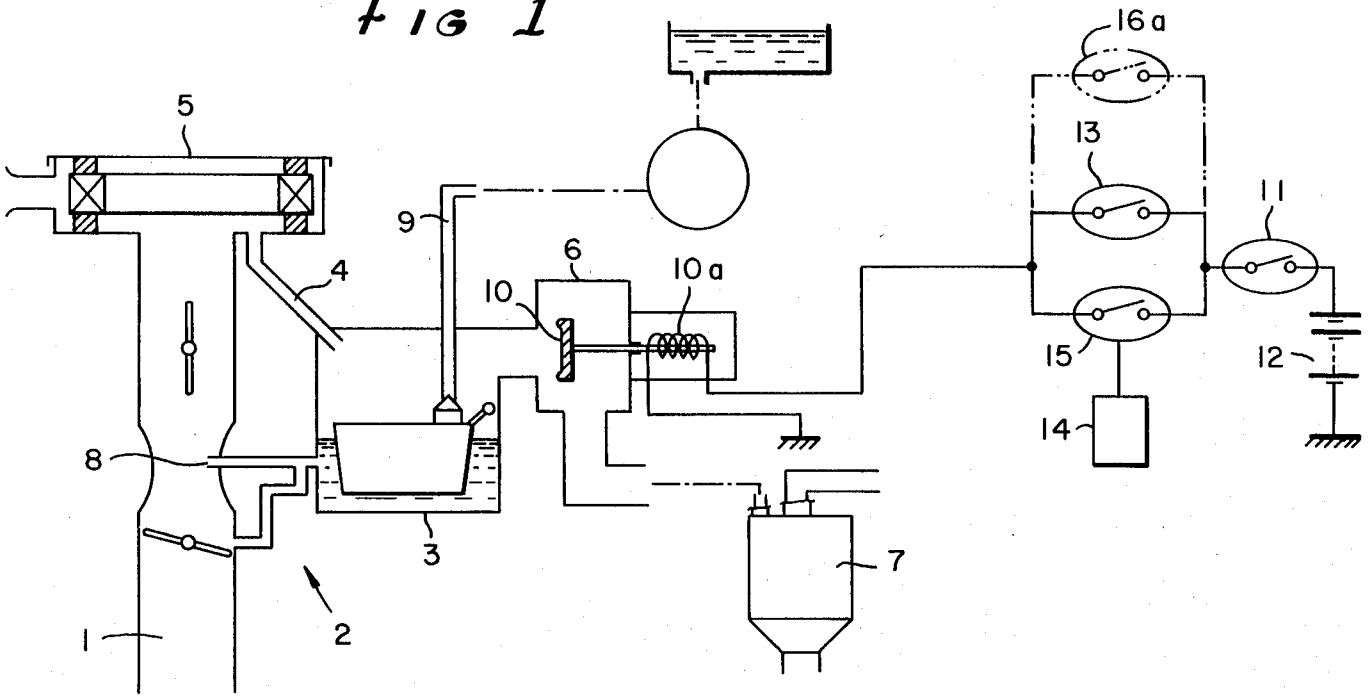
FIG. 1 is a diagram showing a preferred embodiment of this invention in side elevation.

Referring to the drawings, a carburetor 2 is interposed in the engine intake passage 1. A float chamber 3 of the carburetor 2 communicates with the air cleaner 5 at the upstream end of the air intake passage 1 through an upward extending inner vent 4. The float chamber 3 also communicates with the space at the atmospheric side of the canister 7 through the outer vent 6. Fuel in the float chamber 3 is fed into the air intake passage 1 through the fuel nozzle 8. A fuel line 9 brings fuel from a fuel tank through a fuel pump, etc. A cut valve 10 is provided in the outer vent 6 to open and close the vent, the valve being closed during starting of the engine when it is cold.

In accordance with the present invention, the cut valve 10 is opened and then closed with some delay when the engine is started in a high temperature condition. As shown in the drawings, the means to attain this result comprises the cut valve 10 which closes upon energization of the actuating solenoid 10*a*. A circuit is provided for connecting the solenoid 10*a* and an operating power source 12 through the ignition switch 11 of the engine. The circuit includes a temperature switch 13 to open at high temperature and a timer switch 15 to close after predetermined delay in accordance with the operation of the cranking detector 14. Thus, when the engine under the high temperature conditions is started, the temperature switch 13 is open, while the timer switch 15, which initially is opened at the start of cranking, is closed after a predetermined delay from the beginning of the cranking operation. The actuating solenoid 10*a* is then energized and excited to close the cut valve 10. In other words, the cut valve 10 is maintained in open condition for a predetermined time after beginning of the cranking of the hot engine, and high pressure caused in the float chamber 3 at the beginning of the starting operation is exhausted to the atmospheric side of the canister 7 through the cut valve, so that the deficiency described above is eliminated.

Figure 2:
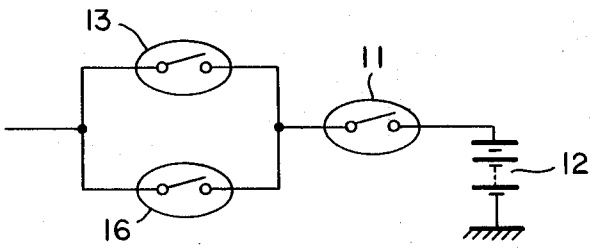
FIG. 2 is a detail showing a modification.

FIG. 2 shows a modification thereof, wherein the timer switch 15 of the above-described embodiment is substituted for a vacuum pressure switch 16 to close in accordance with decrease of the intake vacuum of the engine. In operation, when the engine under a high temperature condition is started, the temperature switch 13 and vacuum pressure switch 16 are opened causing cut valve 10 to remain open. Thereafter the vacuum switch 16 is closed by detecting the decrease of the intake vacuum occurring when the engine is being accelerated to start from the idling condition thereof. At that time the cut valve 10 is closed. The valve 10 is open at the beginning of the engine starting operation and an effect similar to that of the above-described embodiment is attained. The opening of the outer vent 6 has little influence during idling since the mixture merely becomes somewhat enriched, but the cut valve 10 should be closed at the beginning of acceleration, since at that time the throttle valve is opened widely so as to cause the mixture to become over-rich, which produces great influence. Further, in the embodiment shown in FIG. 1, a vacuum switch 16*a* (shown in phantom lines) similar to the vacuum switch 16 in FIG. 2 may be disposed in parallel with the switches 13 and 15, and by virtue of this, the cut valve 10 is closed when the engine is accelerated after starting. Even during the high temperature condition where both the temperature switch 13 and the timer switch are open, the cut valve 10 can be closed to prevent excess enrichment, whereby an effect is attained in that the acceleration ability at starting can be improved.

Further, if the cut valve 10 is maintained open during the acceleration of the engine, the float chamber 3 is affected by the atmosphere at the side of the canister 7 through the cut valve 10, which is not desirable. However, no such deficiency is caused in either of the embodiments described above since the cut valve 10 is closed.

As described above, according to the present invention the cut valve 10 is opened and then closed with delay at the starting of the engine under the high temperature condition, so as to allow the pressure in the float chamber to be exhausted to the canister, whereby achieving an effect such that the deficiency due to the increase of pressure in the float chamber 3 is eliminated.

Having fully described our invention, it is to be understood that we are not to be limited to the details herein set forth but that our invention is of the full scope of the appended claims.

We claim:

1. Apparatus for facilitating the starting of an internal combustion engine, the engine having an air intake passage and a carburetor interposed in said passage, the carburetor including a float chamber having a fuel inlet, and a fuel nozzle communicating with the float chamber and the intake passage, the improvement comprising, in combination: a vent passage leading from said chamber, a cut valve operable to close said vent passage, means for opening said cut valve and maintaining it open during restarting in response to high engine temperature and at least one other engine starting condition to prevent an increase in pressure within the float chamber from delivering an excessive amount of fuel through said fuel nozzle.

2. Apparatus for facilitating the starting of an internal combustion engine, the engine having an air intake passage and a carburetor interposed in said passage, the carburetor including a float chamber having a fuel inlet, and a fuel nozzle communicating with the float chamber and the intake passage, the improvement comprising, in combination: a vent passage leading from said chamber, a cut valve operable to close said vent passage, means for opening and maintaining said cut valve open during restarting in response to high engine temperature and cranking time to prevent an increase in pressure within the float chamber from delivering an excessive amount of fuel through said fuel nozzle.

3. Apparatus for facilitating the starting of an internal combustion engine, the engine having an air intake passage and a carburator interposed in said passage, the carburetor including a float chamber having a fuel inlet, and a fuel nozzle communicating with the float chamber and the intake passage, the improvement comprising, in combination: a vent passage leading from said float chamber, a cut valve operable to close said vent passage, a solenoid for operating said cut valve, and means responsive to high engine temperature for causing said solenoid to open said cut valve and maintain it open during restarting to prevent an increase in pressure within the float chamber from delivering an excessive amount of fuel through said fuel nozzle.

4. The combination set forth in claim 3 in which said means is also responsive to cranking time.

5. The combination set forth in claim 3 in which said vent passage communicates with a fuel canister.

6. Apparatus for facilitating the starting of an internal combustion engine, the engine having an air intake passage and a carburetor interposed in said passage, the carburetor including a float chamber having a fuel inlet, and a fuel nozzle communicating with the float chamber and the intake passage, the improvement comprising, in combination: avent passage leading from said float chamber, a cut valve for closing said vent passage, a solenoid for operating said cut valve to the closed position, a normally closed switch which opens in response to high temperature of the engine, a normally closed timer switch which opens at the start of engine cranking and closes after a predetermined time from the start of cranking, said switches being connected in parallel and positioned in a circuit with said solenoid to close said cut valve upon the closing of either of said switches and opening said cut valve upon the opening of both said switches during hot engine restarting in order to prevent an increase in pressure within the float chamber from delivering an excessive amount of fuel through said fuel nozzle.

7. Apparatus for facilitating acceleration of an internal combustion engine, the engine having an air intake passage and a carburetor interposed in said passage, the carburetor including a float chamber having a fuel inlet, and a fuel nozzle communicating with the float chamber and the intake passage, the improvement comprising, in combination: a vent passage leading from said float chamber, a cut valve operable to close said vent passage, a solenoid for operating said cut valve, and means responsive to high engine temperature and low vacuum intensity in said intake passage for causing said solenoid to open said cut valve during hot restarting to prevent an increase in pressure within the float chamber from delivering an excessive amount of fuel through said fuel nozzle.

* * * * *